US005733225A

United States Patent [19]

Watermiller et al.

[11] Patent Number: 5,733,225

[45] Date of Patent: Mar. 31, 1998

[54] PLAYGROUND APPARATUS

[75] Inventors: Randall G. Watermiller, Buffalo; Steven G. King, Long Lake, both of Minn.

[73] Assignee: Landscape Structures, Inc., Delano, Minn.

[21] Appl. No.: 658,021

[22] Filed: Jun. 4, 1996

[51] Int. Cl.[6] ..... A63B 9/00

[52] U.S. Cl. ..... 482/35; 482/148; 472/137

[58] Field of Search ..... 52/646, 649.3, 52/651.04, 651.11; D21/441–445; 482/35; 472/137

[56] References Cited

U.S. PATENT DOCUMENTS

| | | | |
|---|---|---|---|
| D. 160,419 | 10/1950 | Packer | 482/36 |
| 798,730 | 9/1905 | Johnson | 52/651.11 |
| 1,877,833 | 9/1932 | Ferrell | 482/36 |
| 3,905,548 | 9/1975 | Goff | 52/646 |
| 4,378,112 | 3/1983 | Goldstein . | |
| 4,838,726 | 6/1989 | Lucas Huerta | 52/651.11 |
| 5,356,354 | 10/1994 | Owens | 482/35 |
| 5,364,313 | 11/1994 | Nickelson . | |

*Primary Examiner*—Jerome Donnelly

*Attorney, Agent, or Firm*—Merchant, Gould, Smith, Edell, Welter & Schmidt

[57] ABSTRACT

A playground apparatus is disclosed which includes four upright posts secured in the ground in a square configuration. Playground apparatus further includes four curved beam members formed from substantially rigid material, each of which is pivotally connected at its midpoint. The adjacent ends of the beams are interconnected by a resilient spring assembly, and the assembled beams define a ring-like support surface upon which children can stand and jump, producing undulating and resilient motion.

17 Claims, 5 Drawing Sheets

PLAYGROUND APPARATUS

The invention is broadly directed to playground apparatus for children, and is specifically directed to such an apparatus including a ring-like beam assembly upon which children can jump up and down to produce undulating motion.

Many types of playground apparatus are available for children to use and amuse themselves. A relatively recent development is such an apparatus in which a ring-like, horizontally exposed beam is supported by a plurality of upright posts. See, for example, the "Child Entertainment Device" disclosed in U.S. Pat. No. 5,364,313, in which a torsible beam formed into a ring has portions pivotally connected to several upright posts. The beam itself is U-shaped, and the beam sections are pivotally connected to an associated post through pivot blocks. The torsible beam has sufficient rigidity as to remain in a fixed position when no children are standing on it, and when children mount and stand the beam it flexes and twists as the children jump up and down.

A problem with a torsible beam of this type is that it does not produce significant flexing and twisting in response to a single child jumping up and down. It thus necessitates two or more children to produce the flexing and twisting necessary for children to enjoy it.

We have found that by constructing the beam assembly to include substantially rigid beam segments or members and interconnecting them with a resilient means such as a coil spring, the playground apparatus produces a desirable and entertaining undulating and resiliently pivotal motion that one child or several children may use as playground entertainment.

Specifically, our inventive playground apparatus comprises a plurality of upright posts arranged in a polygon configuration, preferably secured in the ground with concrete, and a like number of beam segments or members that together form a ring-like beam assembly that encircles the posts. Each beam member is substantially rigid, and in the preferred embodiment is formed from a relatively large diameter steel tube (e.g., five inches). The tube is formed into a curved configuration with the plurality of beam members disposed in end to end relation.

Interconnecting the spaced ends of adjacent curved beam members is a resilient connection that preferably takes the form of a coil spring assembly. The coil spring assembly includes an internal rubber boot disposed within the coil spring that reduces the likelihood of catching children's fingers or toes between the coils. The ends of the coil spring are respectively connected to the beam ends through the use of a wedge plate inserted between the end coils at each end of the spring, each of which is bolted to its associated tube end.

Each of the curved beam members is pivotally connected to an associated upright post at an intermediate point, so that the ring-like beam assembly is pivotally movable relative to each post and articulated between the posts through the resilient spring assembly.

The preferred embodiment includes four such upright posts disposed in a square configuration with four beam segments or members each of which is curved to subtend an angle of 90°. In the preferred embodiment, both the upright posts and beam members are formed from steel tubing. Handle members product laterally from each post at the top, enabling children to grasp a stationary part of the apparatus as they jump up and down on the pivotally connected and articulated ring-like beam assembly.

The inventive playground apparatus produces an articulated, resiliently reactive, undulating movement when moved by one or more children. The pivotal movement of one beam segment or member carries with it through the spring assembly pivotal movement of the adjacent beam segments, causing irregular undulating motion that entertains one or more children.

DETAILED DESCRIPTION OF THE PREFERRED EMBODIMENT

Figure 1:
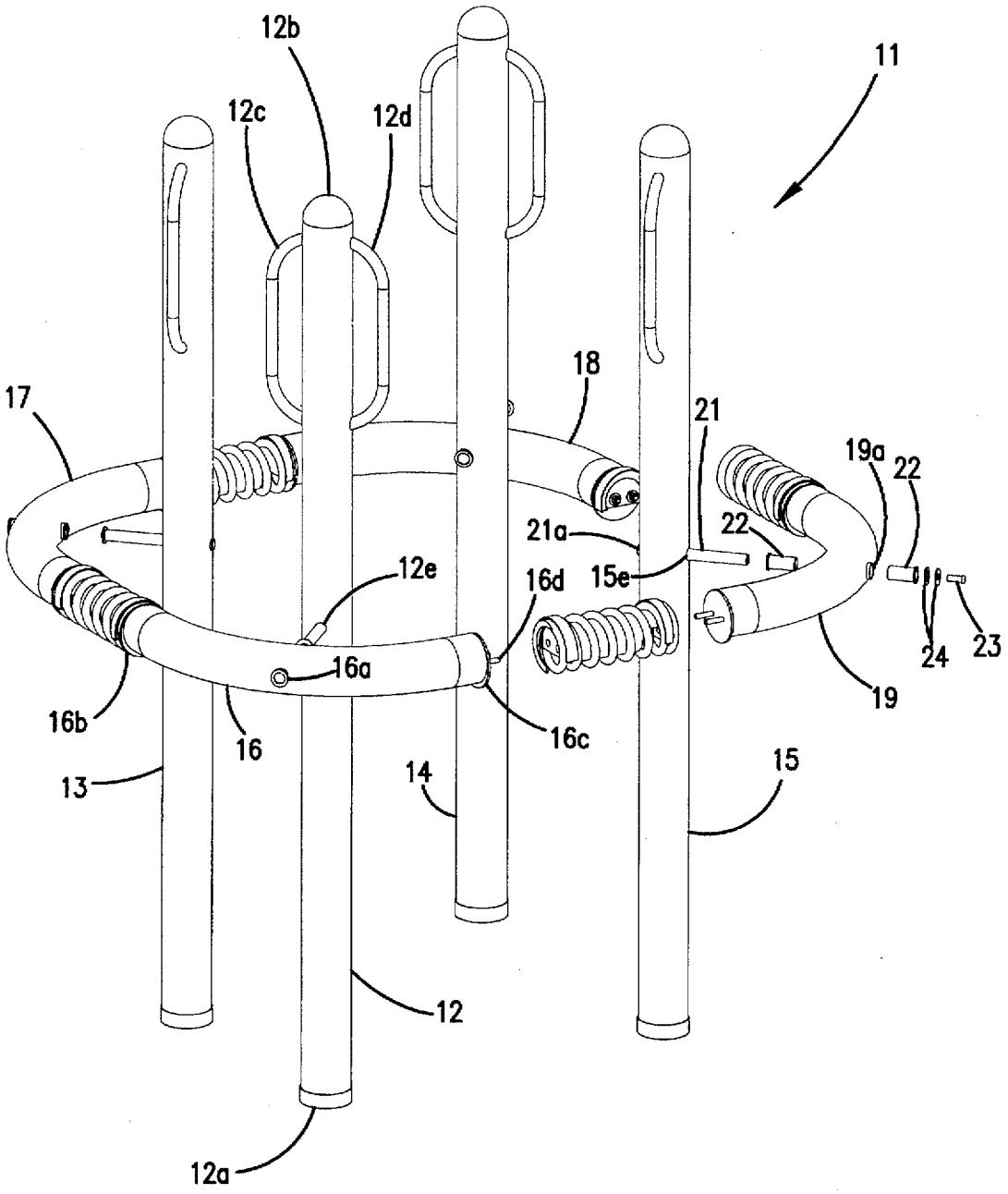
FIG. 1 is an exploded perspective of a playground apparatus embodying the invention.
Figure 2:
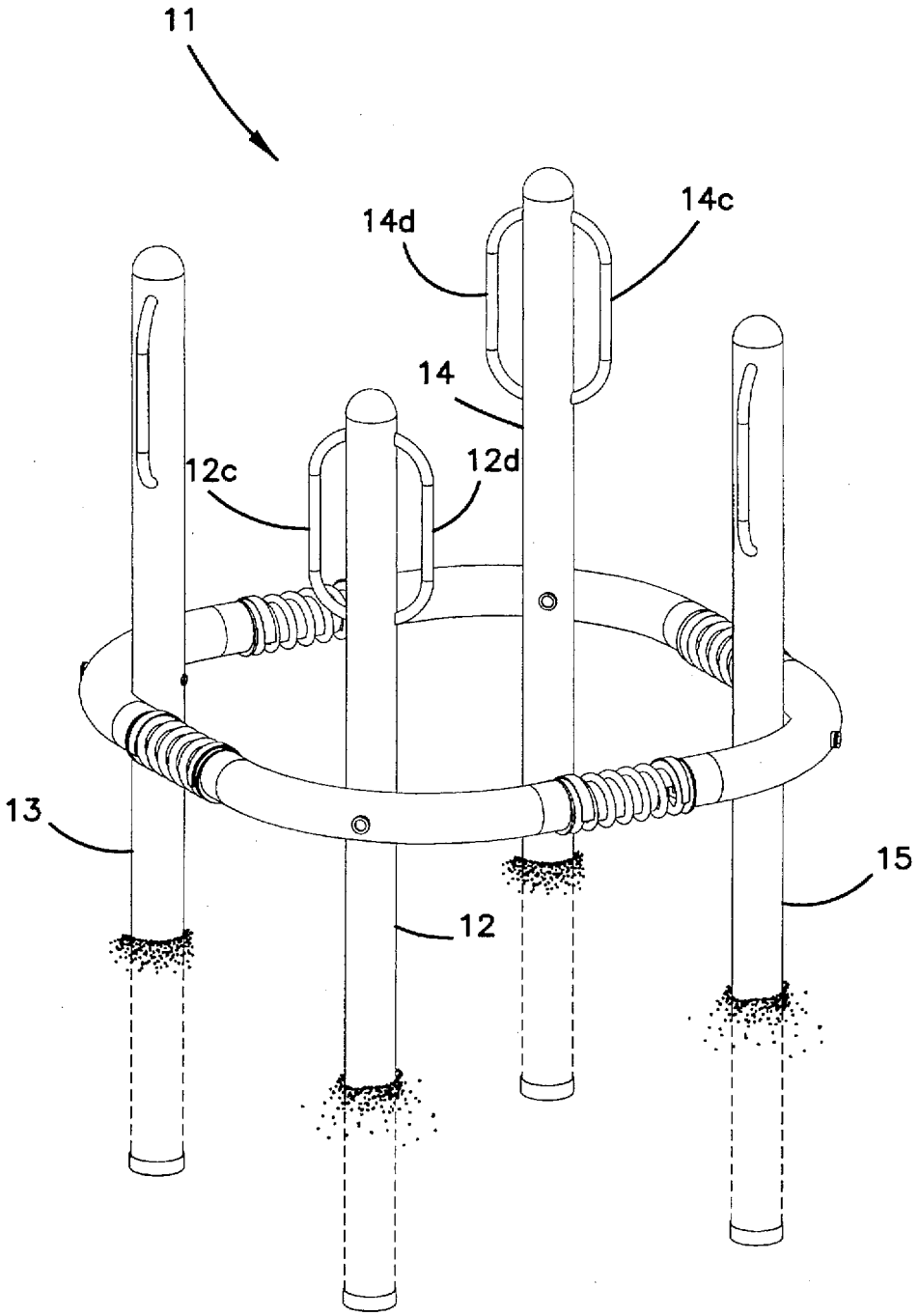
FIG. 2 is a perspective view of the playground apparatus assembled and installed in the ground.

With initial reference to FIGS. 1 and 2, a playground apparatus embodying the invention is represented generally by the numeral 11. Playground apparatus 11 includes four upright support posts 12–15 which are identical in structure and of which post 12 is exemplary. Post 12 is preferably formed from tubular steel and includes a flat bottom cap 12*a* that closes the lower tube end and an upper domed cap 12*b* that closes the upper tube end. Handle members 12*c*, 12*d* are welded to opposite sides of post 12 near its top in a position described in further detail below. A transverse bore 12*e* is formed through post 12 intermediate its ends.

With continued reference to FIG. 2, each of the posts 12–15 is secured in the ground, preferably by placing the post in a footing hole and filling it with concrete. Each of the transverse bores of posts 12–15 is preferably spaced 18–20 inches above the ground. The posts 12–15 are disposed in a square configuration with the transverse bores of the diagonally opposite post pairs 12-14 and 13-15 in colinear alignment. In this position, the various handle members project laterally from each post so that they may be easily grasped by children using the Playground Apparatus 11.

With continued reference to FIGS. 1 and 2, playground apparatus 11 further consists of four beam members 16–19, each of which is respectively associated with one of the posts 12–15. The beam members 16–19 are of identical construction and beam 16 is exemplary.

Beam 16 preferably is formed from large steel tubing although other materials and configurations could be used. In the preferred embodiment, beam 16 is arcuate in shape although other configurations are suitable. A transverse bore 16*a* is formed in colinear relation with the transverse bore 12*e* of post 12, with bore 16*a* located at the midpoint between the ends of beam 16. Based on the use and equal spacing of four posts, the beam configuration as defined by the midpoint and beam ends subtends an angle of 90°.

Figure 7:
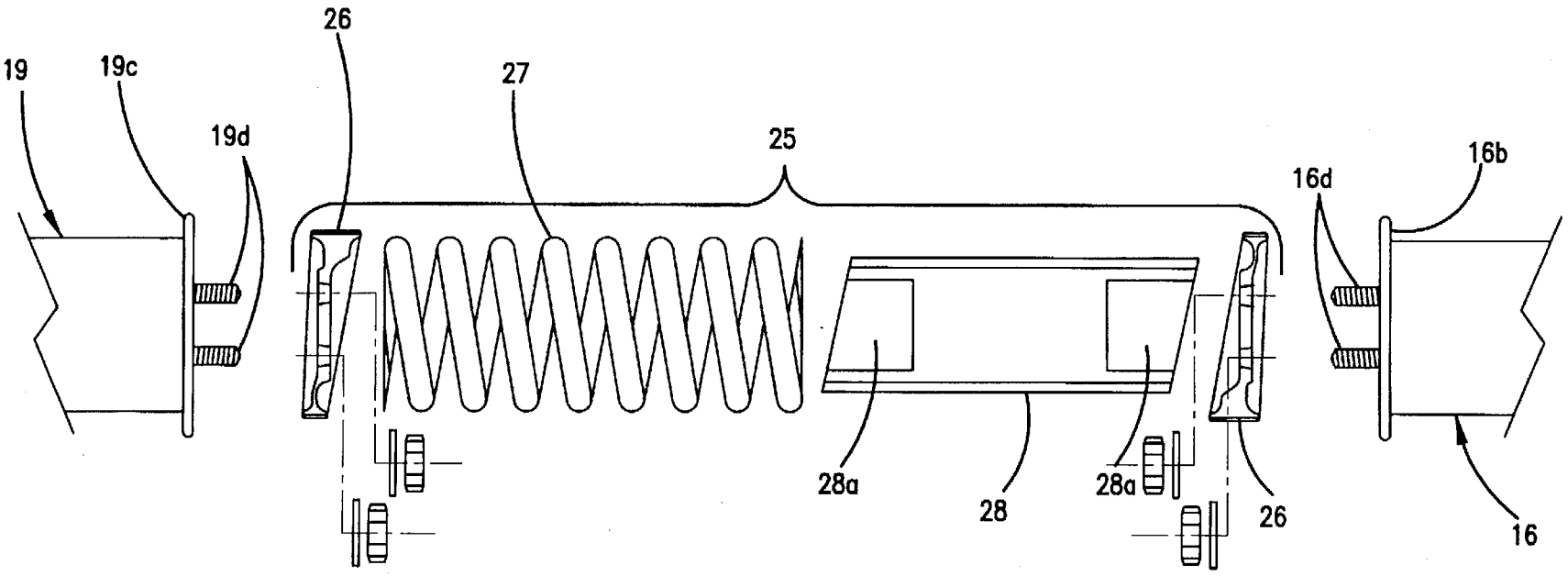
FIG. 7 is a bottom plan view of the spring assembly and fragmentary portions of the ends of two beams.

Circular steel plates 16*b*, 16*c* are welded to each end of beam 16, and each steel plate 16*b,c* has a pair of threaded studs 16*d* projecting laterally therefrom (see also FIG. 7).

Each of the beams 16–19 is movably connected to and supported by the associated post 12–15. This connection is preferably pivotal, and the pivotal connection of beam 19 is exemplary (see FIG. 1). A shaft 21 having an enlarged head 21*a* at its inner end projects through the transverse bore 15*e* of post 15. A pair of oil impregnated bronze bearings 22 are inserted into the transverse bore 19*a* from opposite sides, and the assembly is then placed over shaft 21. A cap screw 23 (with washers 24) is threaded into a threaded bore in the end of shaft 21.

As assembled, beam 19 may freely pivot about the shaft 21 on bearings 22.

With the beams 16–19 pivotally connected to the associated posts 12–15, the ends of adjacent beams are spaced apart from each other as shown, for example, in FIG. 7. These ends are operably and resiliently connected by the spring assembly represented generally by the numeral 25.

Figure 3A:
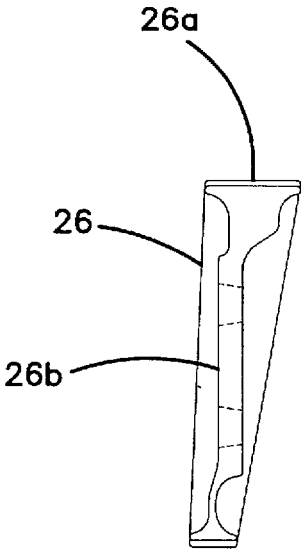
FIG. 3*a* is an enlarged transverse sectional view of a wedge plate used in the spring assembly portion of the playground apparatus.
Figure 3B:
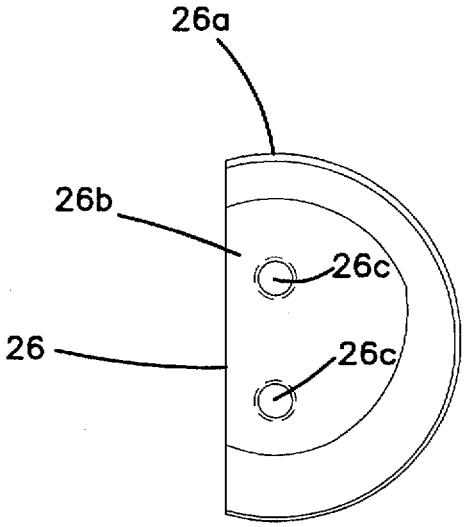
FIG. 3*b* is a front elevation of the wedge plate.
Figure 4A:
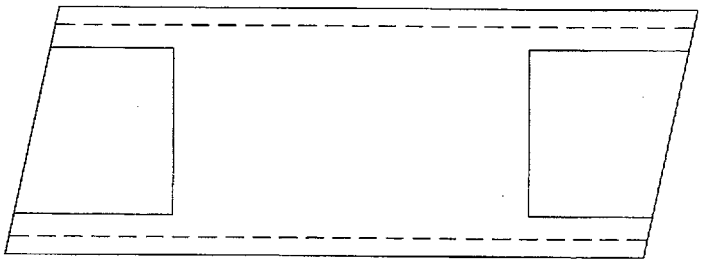
FIG. 4*a* is a side elevation of a rubber boot used in the spring assembly of the playground apparatus.
Figure 4B:
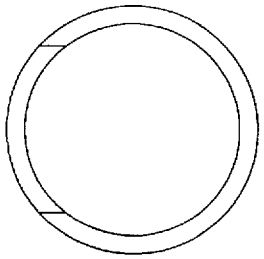
FIG. 4*b* is an end view of the rubber boot.
Figure 5A:
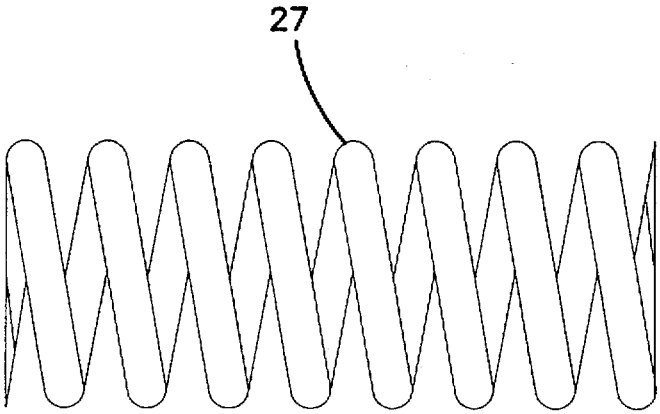
FIG. 5*a* is a side elevation of a coil spring used in the spring assembly of the playground apparatus.
Figure 5B:
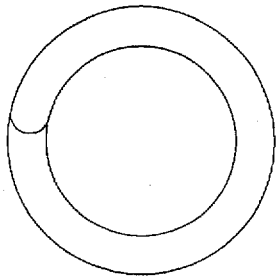
FIG. 5*b* is an end view of the coil spring.

Spring assembly 25 consists of a pair of cast aluminum wedge plates 26 which are specifically shown in FIGS. 3*a* and 3*b*. Each wedge plate 26 is of irregular configuration, including a peripheral rim 26*a* having the form of a truncated circle. The rim 26*a* supports a web portion 26*b* in which a pair or bores 26*c* are formed. The bores 26*c* are sized and spaced to fit over the threaded studs 16*d*, 19*d* as shown in FIG. 7.

Figure 6A:
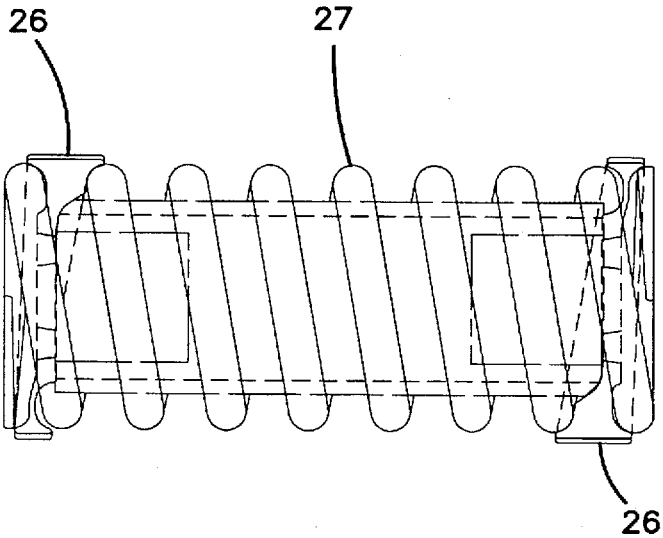
FIG. 6*a* is a bottom plan view of the spring assembly with the wedge plates and rubber boot represented by phantom lines.
Figure 6B:
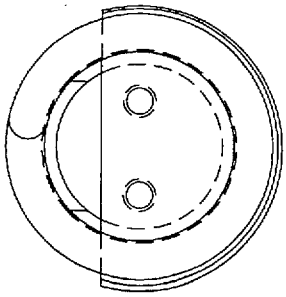
FIG. 6*b* is an end view of the spring assembly of FIG. 6*a*.

Spring assembly 25 further includes a coil spring 27 the diameter of which generally corresponds to the diameter of the beams 16–19. As best shown in FIGS. 6*a*–6*b*, the wedge plates 26 are sized and configured to wedgeably fit into the space between the last two coils on each end of spring 27. The wedge shape of wedge plate 26, as best shown in FIGS. 3*a* and 6*a*, enables it to fit snugly into each end of coil spring 27 and to be retained in this position.

With continued reference to FIGS. 6*a*, 6*b* and 7, spring assembly 25 further comprises a boot 28 that is formed from rubber reinforced with polyester cord. Boot 28 is of generally cylindrical configuration and has an outside diameter that is slightly less than the inside diameter of coil spring 27, enabling it to slide into the center of coil spring 27. Boot 28 substantially fills the internal space within coil spring 27, thus strengthening the resilient support between adjacent beam members and also helping to prevent children from inserting fingers into the spring. As best shown in FIG. 7, its ends are angled slightly in better conformance with the wedge plates 26. It includes two end recesses 28*a* to receive and provide access to threaded studs 16*d*, 19*d*.

The spring assembly 25 is completed with a pair of nut/washer pairs 29 that threadably fit onto the threaded studs 16*d*, 19*d*.

With specific reference to FIG. 6*a*, spring assembly 25 is assembled by placing one of the wedge plates 26 into one end of the spring 27, inserting the rubber boot 28 and then fitting the wedge plate 26 into the opposite end of spring 27. The assembly 25 is placed over each pair of opposed threaded studs 16*d*, 19*d* (FIG. 7), and the nut/washer pairs 29 are then threaded onto the studs 16*d*, 19*d* through the access recesses 28*a*. This brings the ends of the beams 16 and 19 together in such a way that resilient, relative movement therebetween is permitted.

The playground apparatus 11 is assembled and installed by first digging footing holes for the posts 12–15 with the proper spacing. The four beams 16–19 are then positioned on the ground with the beam ends spaced apart an amount corresponding approximately to the length of a spring assembly 25. A spring assembly 25 is then attached to each of the opposed ends of adjacent beams by threading the nut/washer pairs 29 onto the threaded studs 16*d*–19*d*.

With the beam fully assembled, it is placed right side up encircling the footing holes. Posts 12–15 are then placed in the footing holes, and each of the beams 16–19 is pivotally connected to the associated post 12–15 with the pivot and bearing components 21–24. With the posts 12–15 plumb and the beam assembly consisting of beams 16–19 and spring assemblies 25 in a substantially level (horizontal) position, concrete is poured into the footing holes and allowed to set prior to use.

As assembled and installed, the beam assembly defines a ring-like support surface that is approximately 18–20 inches above the ground, enabling children to climb onto the beam assembly at various points between the respective posts 12–15. Handle members 12*c*–15*c* and 12*d*–15*d* can be grasped by the child for stability.

Playground apparatus 11 may be enjoyed by a single child or by several children. In either case, the child jumps up and down on the beam assembly, which results in resilient and pivotal movement of each of the beam members 16–19, and undulating and resilient motion by the entire beam assembly. The motion is enhanced when two or more children use their body weight to spring each other on the beam assembly.

The playground apparatus shown in the preferred embodiment is based on the use of four posts arranged in a square configuration and four beams each of which is configured to subtend an angle of 90°. While this is the preferred form of the invention , it is possible for the playground apparatus to include a different number of posts and like number of beams arranged in different configurations. For example, as few as two posts and beams can be used, in which case the beams would occupy or subtend an angle of 180°. Similarly, the use of three posts arranged in an equilateral would require three beams each of which subtends an angle of 120°, and five posts arranged in a pentagon would use five beams each of which subtends an angle of 72°. The essential aspects of the invention are the use of substantially rigid beams that are pivotally or otherwise movably connected to an associated support post with the spaced ends of adjacent beam members interconnected by a resilient or springy connection.

We claim:

1. Playground apparatus comprising:

a plurality of upright support means disposed in spaced relation and defining a polygon; and a beam assembly comprising:

a like plurality of beam members each having first and second ends and an intermediate point therebetween, said ends and intermediate point subtending an angle generally corresponding to an angle of the polygon;

each beam member being movably connected at said intermediate point to an associated upright support means to be generally horizontally disposed in an at rest position; and resilient connection means interconnecting the ends of adjacent beam members to each other so that the beam assembly defines a beam surface upon which children can stand and jump, the resilient connection means being constructed and arranged to permit the beam members to be resiliently moved relative to each other in response to weighting movement by one or more children on said beam surface.

2. The playground apparatus defined by claim 1, which comprises four of said upright support means disposed in a rectangular configuration and four of said beam members, the ends and intermediate point of each beam member subtending an angle of 90°.

3. The playground apparatus defined by claim 2, wherein said four upright support means are disposed in a square and the intermediate point of said beam members corresponds to the midpoint thereof.

4. The playground apparatus defined by claim 1, wherein each upright support means comprises a post.

5. The playground apparatus defined by claim 4, wherein each post is formed from tubular steel.

6. The playground apparatus defined by claim 1, wherein each beam member is formed from substantially rigid tubular material.

7. The playground apparatus defined by claim 6, wherein each beam member is formed from tubular steel.

8. The playground apparatus defined by claim 6, wherein each beam member is arcuate in configuration.

9. The playground apparatus defined by claim 6, wherein the ends and intermediate point of each beam member subtend an angle of 90°.

10. The playground apparatus defined by claim 1, wherein the resilient connection means comprises a coil spring having first and second ends, and connecting means for connecting each end of the coil spring to the adjacent end of the associated beam member.

11. The playground apparatus defined by claim 10, wherein the resilient connection means further comprises a resilient boot member disposed internally of the coils of each coil spring, the boot member substantially filling the internal space within said coil spring.

12. The playground apparatus defined by claim 11, wherein the coil spring and boot member are generally cylindrical in configuration.

13. The playground apparatus defined by claim 11, wherein the boot member is formed from rubber reinforced with polyester cord.

14. The playground apparatus defined by claim 10, wherein the connecting means comprises:

mounting means disposed on each end of each beam member;

wedge means sized and configured to be wedgeably disposed between the coils of the adjacent coil spring end; and fastening means for fastening the wedge plate means to the mounting means.

15. The playground apparatus defined by claim 14, wherein the mounting means comprises threaded bolt means projecting axially outward from the associated beam member and, the wedge means comprises a wedge plate with an aperture therethrough for said bolt means, and the fastening means comprises threaded nut means threaded onto the bolt means on the side of the wedge plate opposite the end of the associated beam member.

16. The playground apparatus defined by claim 15, which further comprises a resilient boot member disposed internally of the coils of the coil spring, the boot member substantially filling the internal space within said coil spring.

17. The playground apparatus defined by claim 15, wherein the resilient boot member is formed with an axially extending recess at each end to permit access to each threaded nut means.

* * * * *